US012649551B2

(12) United States Patent
Huang et al.

(10) Patent No.: US 12,649,551 B2
(45) Date of Patent: Jun. 9, 2026

(54) BIOMIMETIC TURTLE

(71) Applicant: Pioneer Material Precision Tech Co., Ltd., New Taipei City (TW)

(72) Inventors: Wei-Yu Huang, New Taipei City (TW); Chang-Qi Zhang, New Taipei City (TW); Guan-Hao Pan, New Taipei City (TW); Li-Yuan Yeh, New Taipei City (TW); Tai-Yu Chen, New Taipei City (TW); Ching-Hung Liu, New Taipei City (TW); Jian-Jhih Huang, New Taipei City (TW); Ching-Shu Lai, New Taipei City (TW)

(73) Assignee: PIONEER MATERIAL PRECISION TECH CO., LTD., New Taipei City (TW)

( * ) Notice: Subject to any disclaimer, the term of this patent is extended or adjusted under 35 U.S.C. 154(b) by 405 days.

(21) Appl. No.: 18/400,007

(22) Filed: Dec. 29, 2023

(65) Prior Publication Data

US 2025/0121920 A1 Apr. 17, 2025

(30) Foreign Application Priority Data

Oct. 13, 2023 (TW) ..... 112139104

(51) Int. Cl.
*B63G 8/00* (2006.01)
*B63G 8/08* (2006.01)

(52) U.S. Cl.
CPC ..... *B63G 8/001* (2013.01); *B63G 8/08* (2013.01); *B63G 2008/002* (2013.01)

(58) Field of Classification Search
CPC ..... B63G 8/001; B63G 8/08; B63G 2008/002
See application file for complete search history.

(56) References Cited

U.S. PATENT DOCUMENTS 6,790,119 B1 * 9/2004 Chia ..... A63H 23/14 446/353

FOREIGN PATENT DOCUMENTS

| | | | | |
|---|---|---|---|---|
| CN | 216887174 U | * | 7/2022 | |
| CN | 115071933 A | * | 9/2022 | ..... B63C 11/52 |
| CN | 217703450 U | * | 11/2022 | |
| CN | 116534228 A | * | 8/2023 | ..... B63H 1/36 |

* cited by examiner

*Primary Examiner* — Stephen P Avila
(74) *Attorney, Agent, or Firm* — HSML P.C.

(57) ABSTRACT

A biomimetic turtle includes a trunk, a head movably connected with a front end of the trunk in the front-rear direction, two front limbs disposed on a front section of the trunk and each rotatable relative to the trunk to sway in an up-down direction, and a driving module to drive the head and the front limbs. Each front limb has a curve-shaped rigid portion with a recess, and a deformable flipper portion engaged in the recess and extending rearwardly. With the deformable flipper portion deformed and bent during swaying of the front limbs, a forward propelling force is generated to propel the biomimetic turtle forwardly. The head is operably movable to vary the center of gravity of the biomimetic turtle 100 in the water, and thus the front portion of the biomimetic turtle is inclined upwardly or downwardly to facilitate ascending or descending of the biomimetic turtle.

9 Claims, 15 Drawing Sheets

BIOMIMETIC TURTLE

CROSS-REFERENCE TO RELATED APPLICATION

This application claims priority to Taiwanese Patent Application No. 112139104, filed on Oct. 13, 2023, and incorporated by reference herein in its entirety.

FIELD

The disclosure relates to a biomimetic underwater robot, and more particularly to a biomimetic turtle with a driving module to float upward and dive downward in the water.

BACKGROUND

A variety of biomimetic underwater robots have been developed that emulate the shape of an animal and its swimming motion in the water. However, conventional biomimetic turtles have complicated construction in order to simulate a turtle swimming freely in the water, and are costly to manufacture.

SUMMARY

Therefore, an object of the disclosure is to provide a biomimetic turtle that can alleviate at least one of the drawbacks of the prior art.

According to the disclosure, the biomimetic turtle includes a trunk, a head, two front limbs and a driving module. The head is connected with a front end of the trunk in a front-rear direction, and is movable relative to the trunk in the front-rear direction. The two front limbs are disposed on a front section of the trunk and extend therefrom in a left-right direction away from each other. Each of the front limbs is rotatable relative to the trunk about a front rotating axis to sway in an up-down direction. Each of the front limbs has a curve-shaped rigid portion which defines a front contour of the front limb and which has a recess that is opened rearwardly, and a deformable flipper portion which is engaged in the recess and which extends rearwardly from the rigid portion. The driving module is mounted on the trunk to drive movement of the head and rotation of the front limbs.

With the deformable flipper portion deformed and bent during swaying of the front limbs in the up-down direction, a forward propelling force is generated to propel the biomimetic turtle forwardly. Also, with the head operably movable relative to the trunk in the front-rear direction, the center of gravity of the biomimetic turtle 100 (or the position of generated buoyant force) can be varied in the water, and thus the front portion of the biomimetic turtle is hence inclined upwardly or downwardly to facilitate ascending or descending of the biomimetic turtle. The biomimetic turtle has a simple structure and can swim freely in the water.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 1:
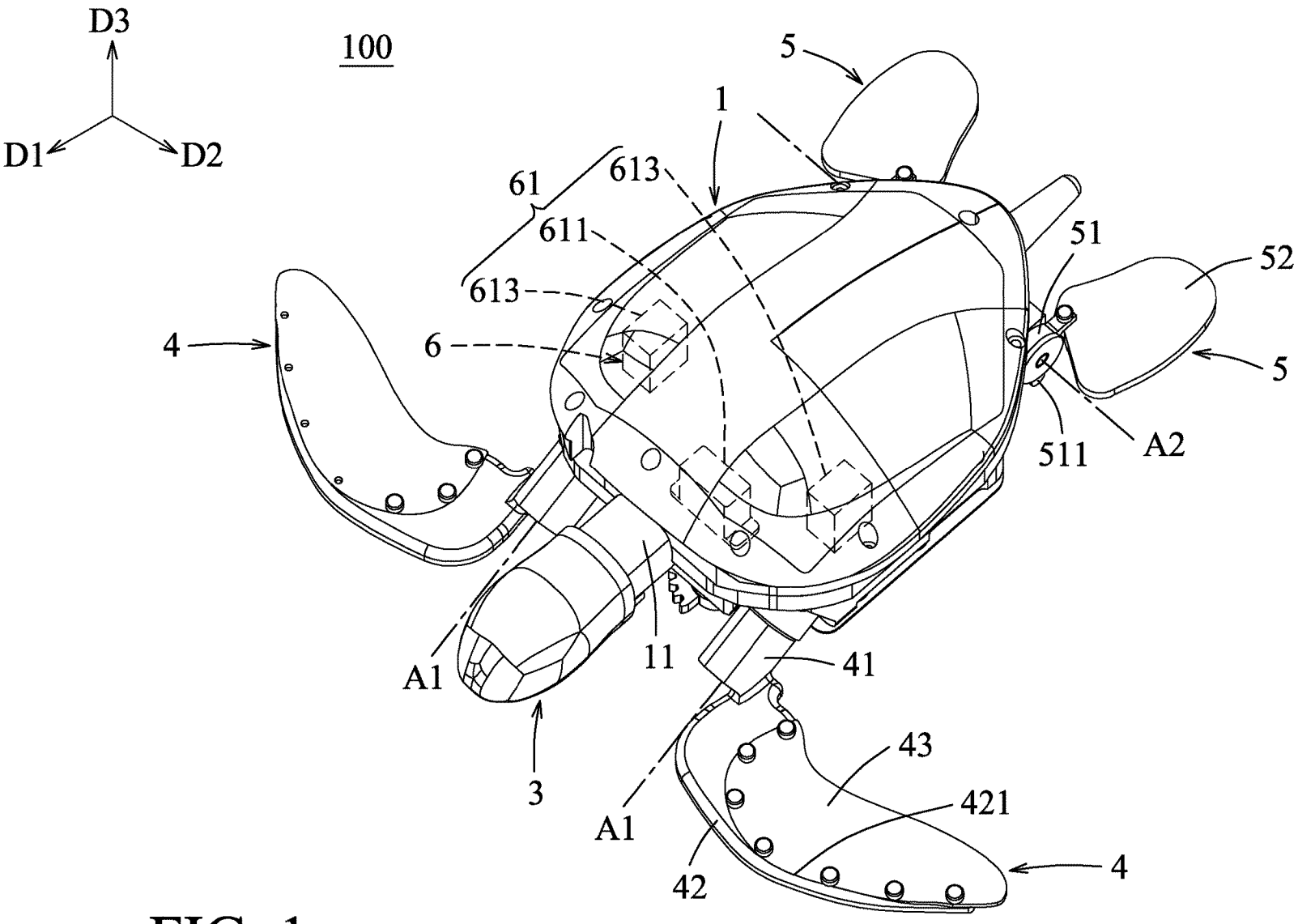
FIG. 1 is a perspective view illustrating an embodiment of a biomimetic turtle according to the disclosure.
Figure 2:
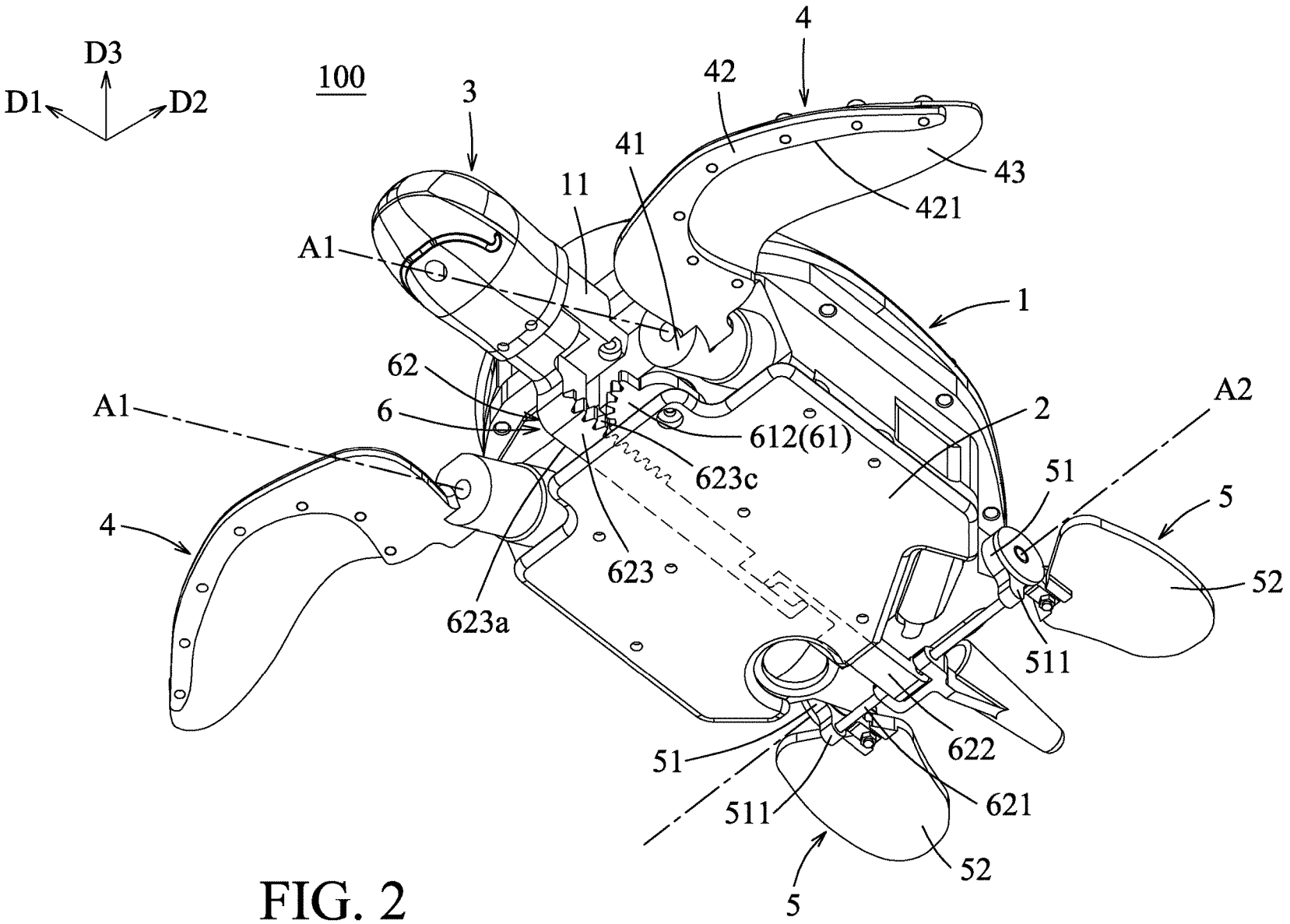
FIG. 2 is a perspective view of the embodiment taken from another angle.
Figure 3:
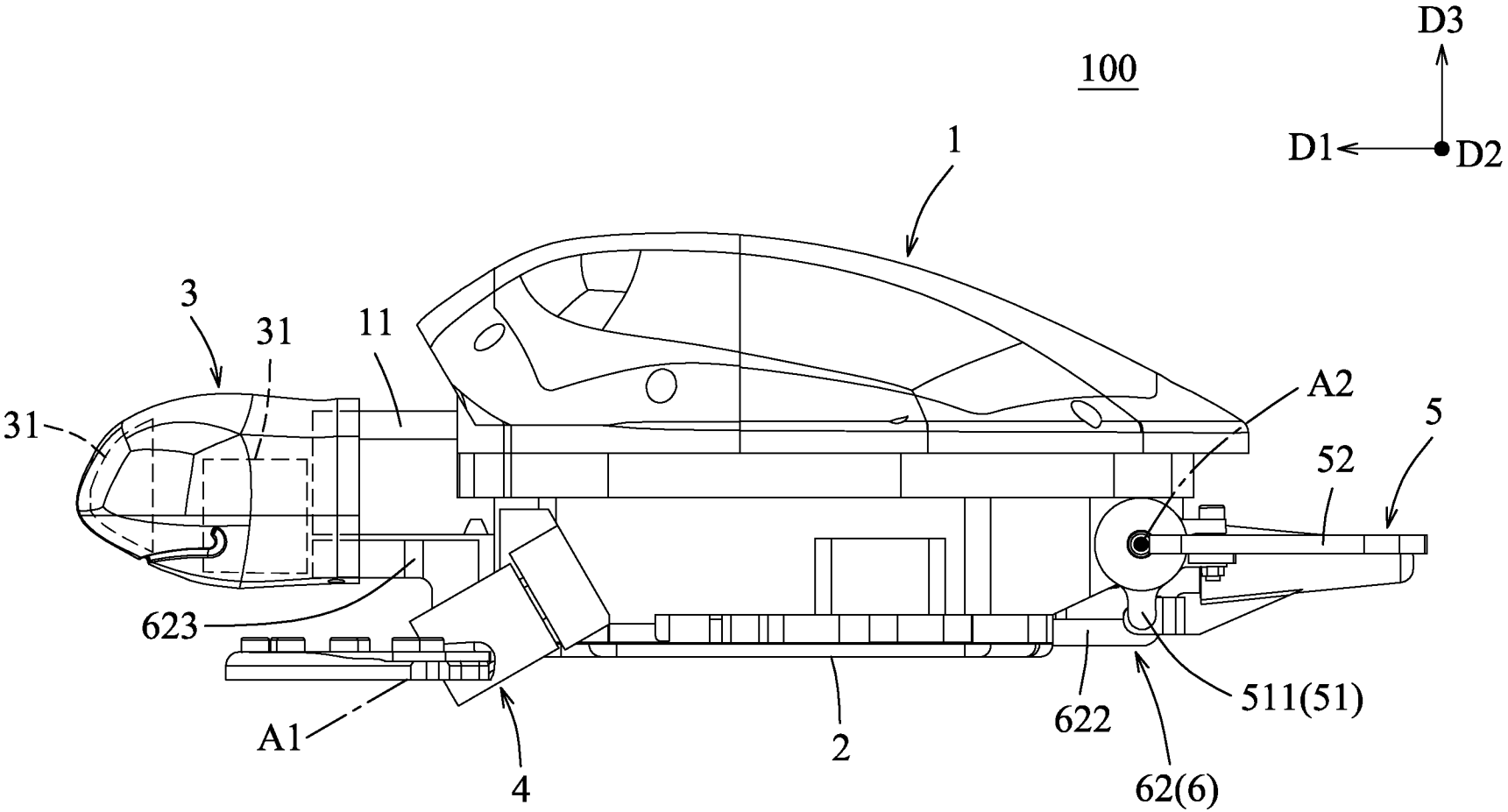
FIG. 3 is a side view of the embodiment.
Figure 4:
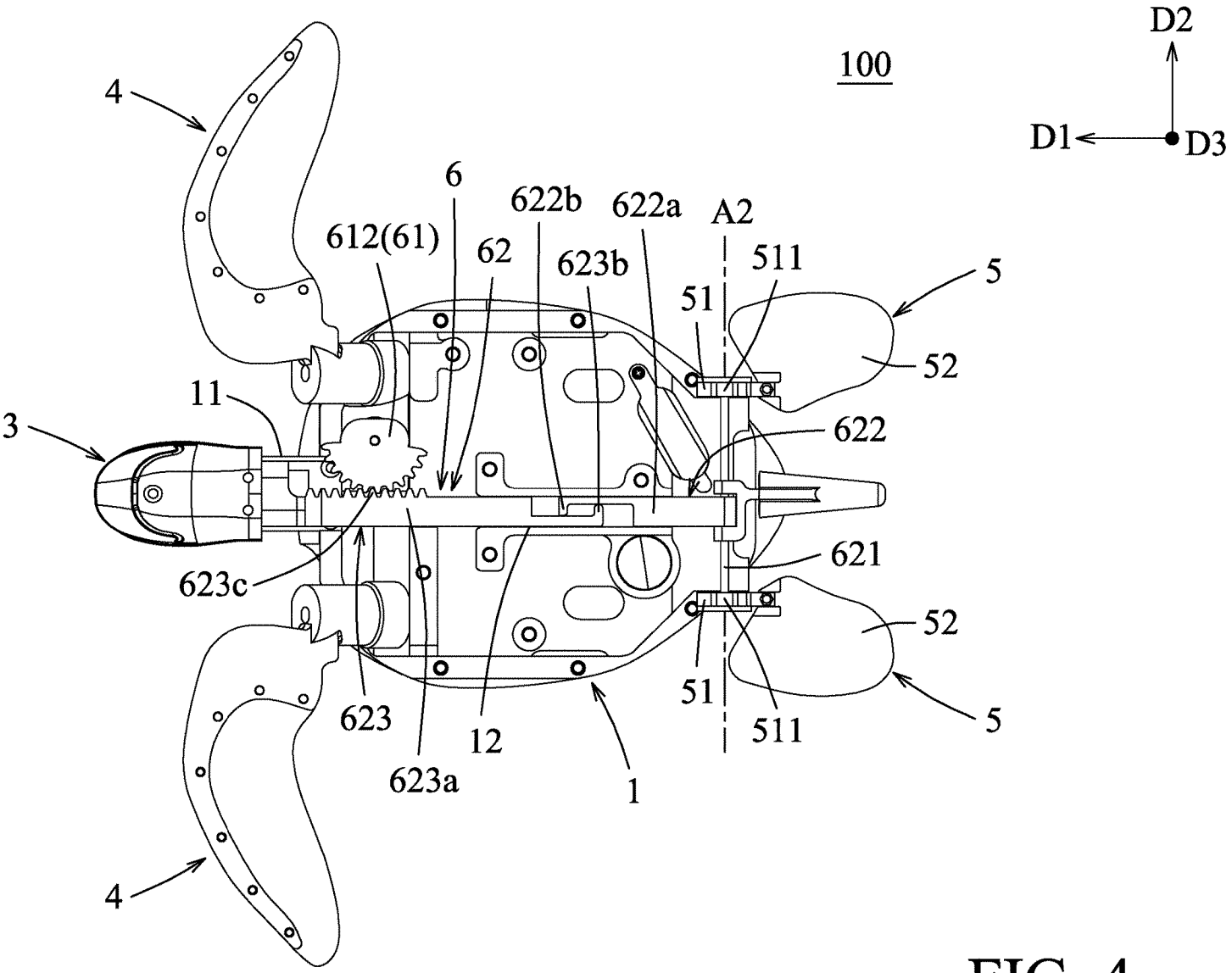
FIG. 4 is a bottom view of the embodiment, with a bottom cover being removed for the sake of clarity.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Referring to FIGS. 1 to 4, an embodiment of a biomimetic turtle 100 according to the disclosure is adapted to be movable in the water. The biomimetic turtle 100 includes a trunk 1, a bottom cover 2, a head 3, two front limbs 4, two rear limbs 5 and a driving module 6.

The trunk 1 has a fixed stem 11 which extends forwardly from a front section thereof in a front-rear direction (D1), and a guide rail 12 formed on a bottom portion thereof and extending in the front-rear direction (D1). The bottom cover 2 is disposed to cover the bottom portion of the trunk 1 to conceal the guide rail 12.

The head 3 is slidably sleeved around the fixed stem 11 to be movable relative to the trunk 1 in the front-rear direction (D1). The head 3 is hollow, and is provided with a plurality of high-density weight blocks 31 (with a density larger than water) disposed therein to regulate weight of the head 3. For example, the high-density weight blocks 31 may be lead blocks. Specifically, the head 3 is movable relative to the trunk 1 between a front position which is remote from a rear section of the trunk 1, and a rear position which is proximal to the rear section of the trunk 1. Also, the head 3 is movable relative to the trunk 1 to a front transition position and a rear transition position during movement from the front position to the rear position. Through the movement of the head 3 in the front-rear direction (D1), the center of gravity of the biomimetic turtle 100 can be varied in the water. In a modified embodiment, a plurality of low-density weight blocks (not shown) may be disposed in the head 3, such as Styrofoam material blocks, so as to generate a buoyant force in the water and adjust the center of gravity of the biomimetic turtle 100 in the water.

The two front limbs 4 are disposed on a front section of the trunk 1 and extend therefrom in a left-right direction (D2) away from each other. Each front limb 4 is rotatable relative to the trunk 1 about a front rotating axis (A1) that is parallel to the front-rear direction (D1) so as to sway in an up-down direction (D3). Specifically, each front limb 4 has an axle portion 41 which is rotatable relative to the trunk 1 about the front rotating axis (A1), a curve-shaped rigid portion 42 which extends from the axle portion 41 in the left-right direction (D2) to define a front contour of the front limb 4 and which has a recess 421 that is opened rearwardly, and a deformable flipper portion 43 which is engaged in the recess 421 and which extends rearwardly from the rigid portion 42. Specifically, the rigid portion 42 is made of a rigid plastic material, and the deformable flipper portion 43 is made of a silicone rubber or other flexible materials.

Figure 6:
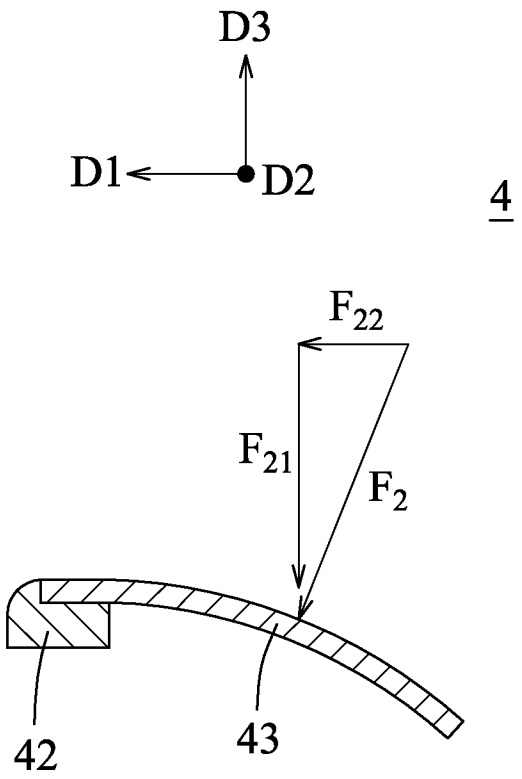
FIG. 6 is a schematic sectional view illustrating when the front limb sways upwardly in the water.
Figure 5:
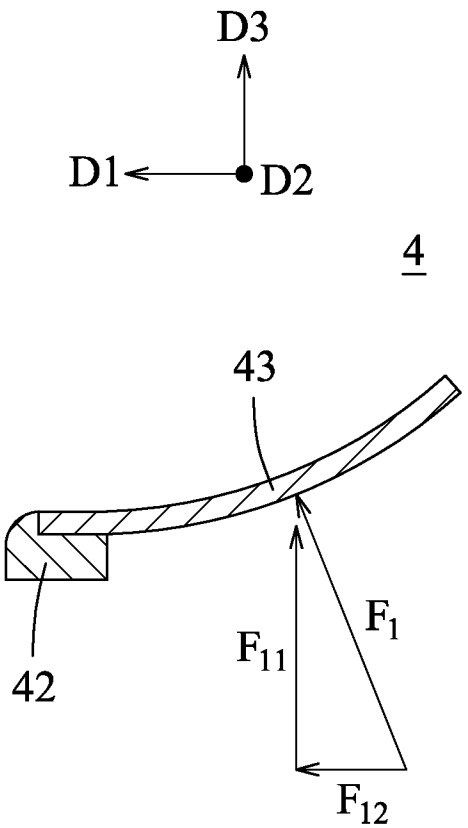
FIG. 5 is a schematic sectional view of a front limb of the embodiment, illustrating when the front limb sways downwardly in the water.

With reference to FIG. 5, when each front limb 4 sways downwardly and is subjected to an upward resistance (F1) by the water, a rear section of the deformable flipper portion 43 is deformed and bent upwardly due to an upward component of force (F11), and a forward component of force (F12) is generated to propel the front limb 4 forwardly. With reference to FIG. 6, when each front limb 4 sways upwardly and is subjected to a downward resistance (F2) by the water, the rear section of the deformable flipper portion 43 is deformed and bent downwardly due to a downward component of force (F21), and a forward component of force (F22) is generated to propel the front limb 4 forwardly. That is, when the deformable flipper portions 43 of the two front limbs 4 sway in the up-down direction (D3), a forward propelling force is generated to propel the biomimetic turtle 100 forwardly.

The two rear limbs 5 are pivotably connected with the rear section of the trunk 1 and extend rearwardly. Each rear limb 5 has an axle section 51 which is journalled on the trunk 1 to be rotatable relative to the trunk 1 about a rear rotating axis (A2) that is parallel to the left-right direction (D2), and a hind flipper section 52 which extends rearwardly from the axle section 51. The axle section 51 has a protrusion 511 protruding downwardly therefrom.

The driving module 6 is mounted on the trunk 1, and includes a driving unit 61 to drive the movement of the head 3 and the rotations of the front limbs 4, and a transmitting mechanism 62 which interconnects the head 3 and each rear limb 5 to transmit a force from the head 3 to move the rear limbs 5 relative to the trunk 1. The driving unit 61 may include a first servomotor 611 for driving the movement of the head 3, a pinion 612 mounted on the first servomotor 611, and two second servomotors 613 for respectively driving the rotations of the front limbs 4. Specifically, the two front limbs 4 are respectively driven by the two second servomotors 613 so as to be rotated independently from each other. Thus, the two front limbs 4 can sway with different speeds so as to permit the biomimetic turtle to steer and change directions during an advancing movement thereof.

The transmitting mechanism 62 includes a crosspiece 621 which extends in the left-right direction (D2) to interconnect the protrusions 511 of the rear limbs 5, a rear sliding rod 622 which has a rear end connected with the crosspiece 621 and which is slidable along and engaged with the guide rail 12 in the front-rear direction (D1), and a front sliding rod 623 which has a front end connected with the head 3, which is disposed forwardly of the rear sliding rod 622 and which is slidable along and engaged with the guide rail 12 in the front-rear direction (D1). The front sliding rod 623 is disposed to move the rear sliding rod 622 in the front-rear direction (D1) so as to transmit a force from the head 3 to move the rear limbs 5. Specifically, the rear sliding rod 622 has a rear rod portion (622*a*) connected with the crosspiece 621, and a rear anchoring portion (622*b*) extending forwardly from the rear rod portion (622*a*). The front sliding rod 623 has a front rod portion (623*a*) connected with the head 3 at a front end thereof, a front anchoring portion (623*b*) extending rearwardly from the front rod portion (623*a*), and a rack portion (623*c*) formed on a side of the front rod portion (623*a*). In this embodiment, the rack portion (623*c*) meshes with the pinion 612 so as to drive the movement of the head 3 in the front-rear direction (D1) by the first servomotor 611.

Figure 7:
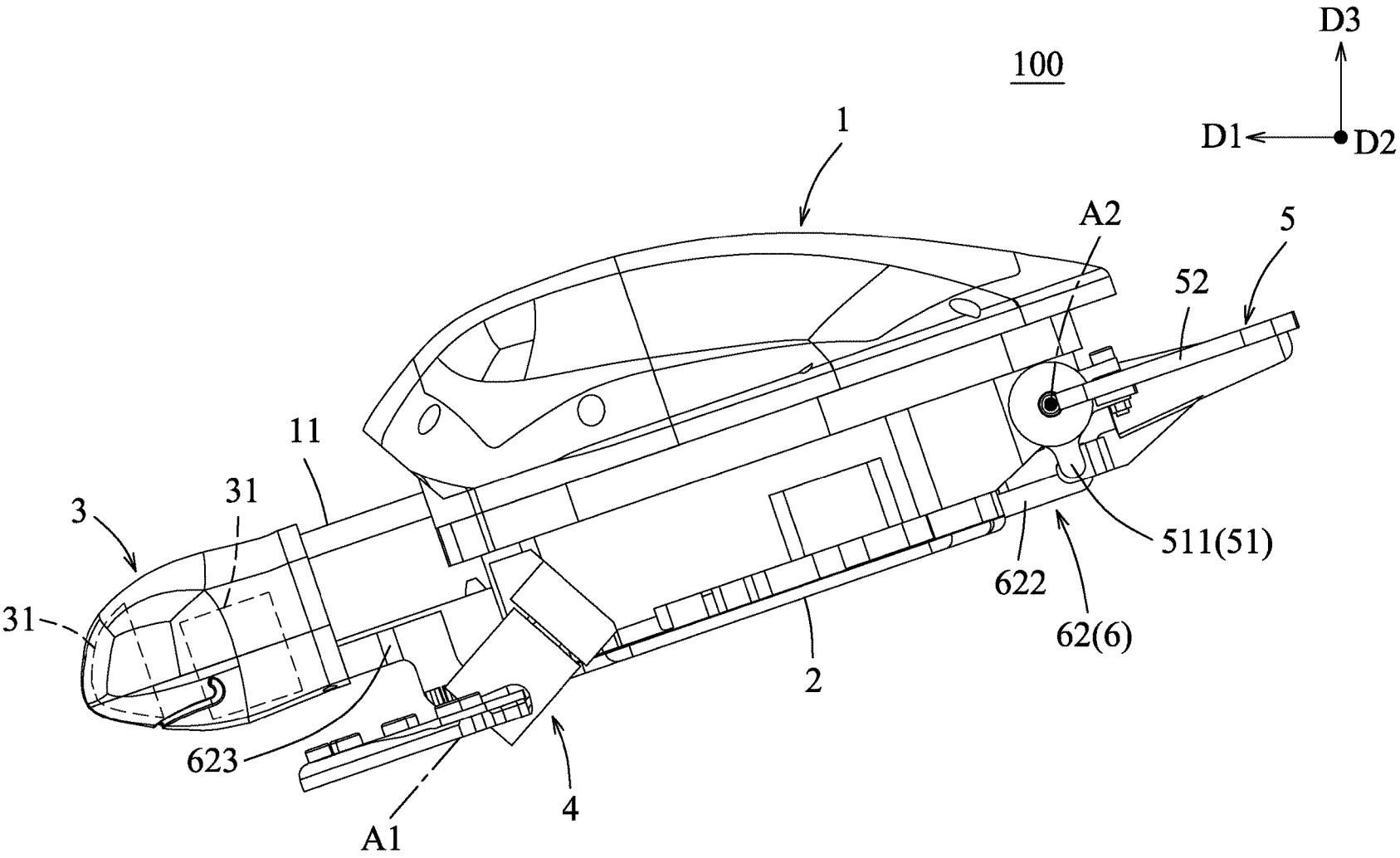
FIG. 7 is a side view illustrating a state when a head of the embodiment is in a front transition position and a front portion of the embodiment is inclined downwardly.
Figure 8:
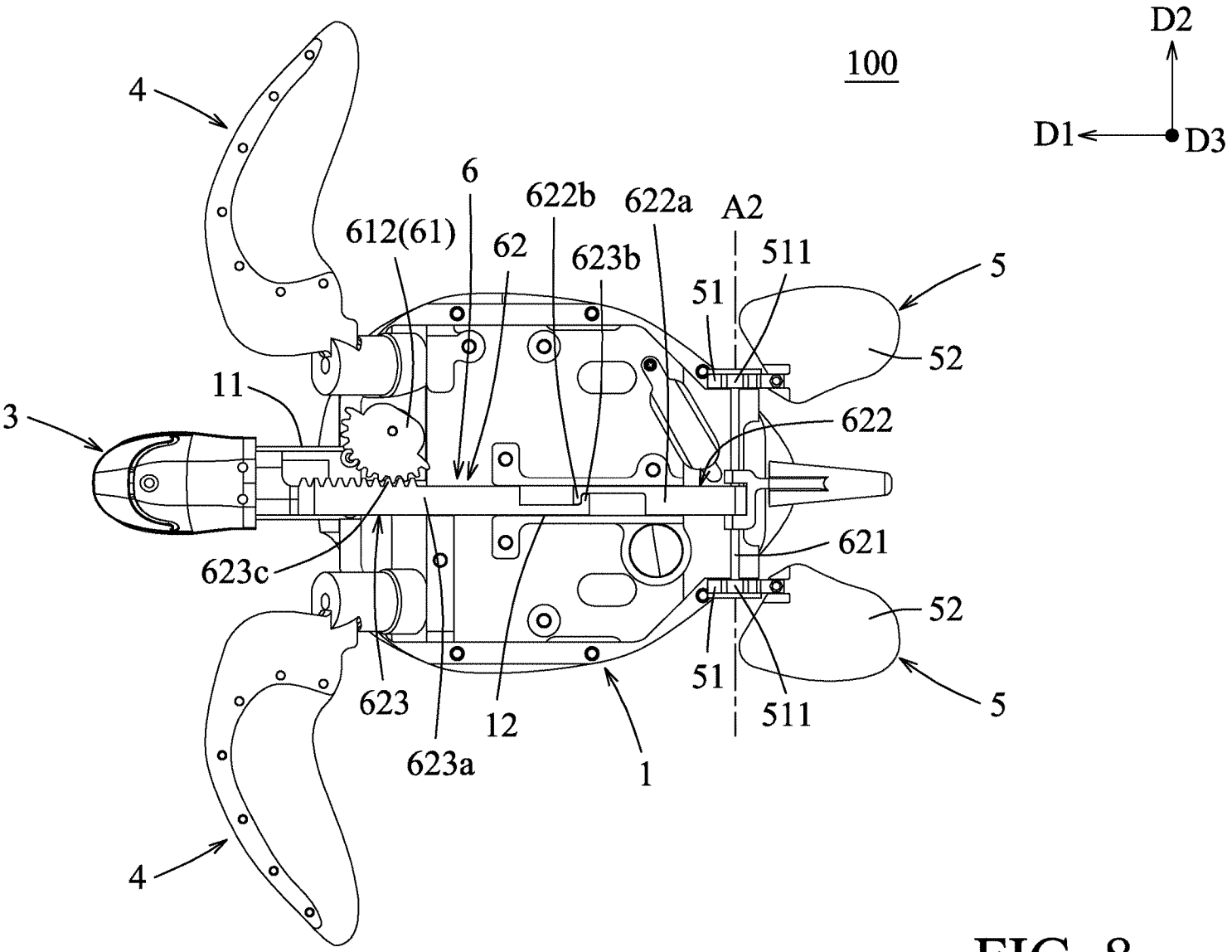
FIG. 8 is a bottom view with the bottom cover being removed, illustrating a state when the head is in the front transition position.

With reference to FIGS. 7 and 8, when the head is in the front transition position, the front anchoring portion (623*b*) abuts against the rear anchoring portion (622*b*), and the rear ends of the rear limbs 5 extend rearwardly and parallel to the trunk 1. In this state, through the high-density weight blocks 31 being moved forwardly with the head 3, the center of gravity of the biomimetic turtle 100 is transferred to a forward site to facilitate a downward inclination of the front portion of the biomimetic turtle 100 in the water. Also, the swaying of the two front limbs 4 in the up-down direction (D3) further facilitates the biomimetic turtle 100 to descend.

Figure 9:
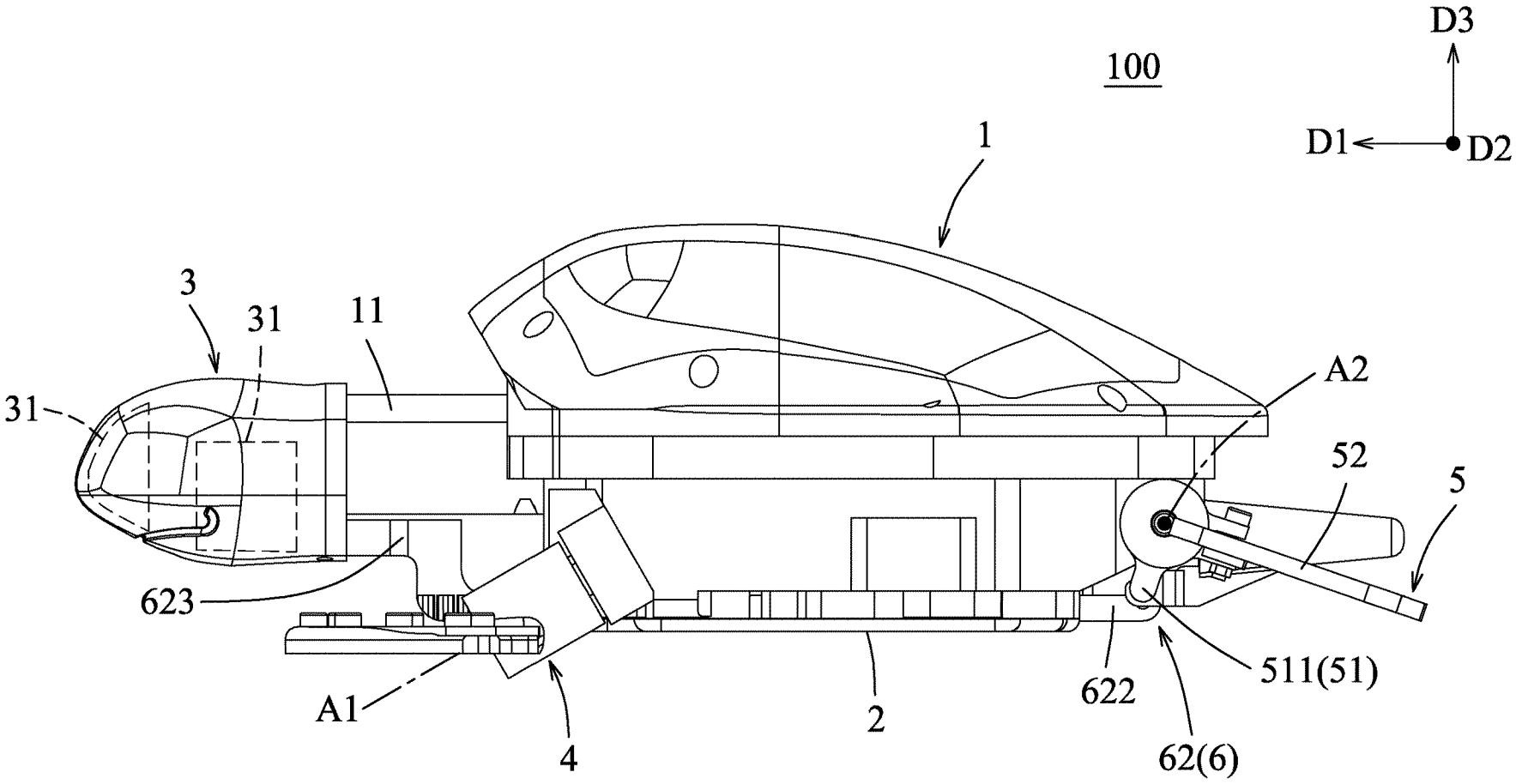
FIG. 9 is a side view illustrating a state when the head is in a front position and rear ends of two rear limbs of the embodiment are inclined downwardly.
Figure 10:
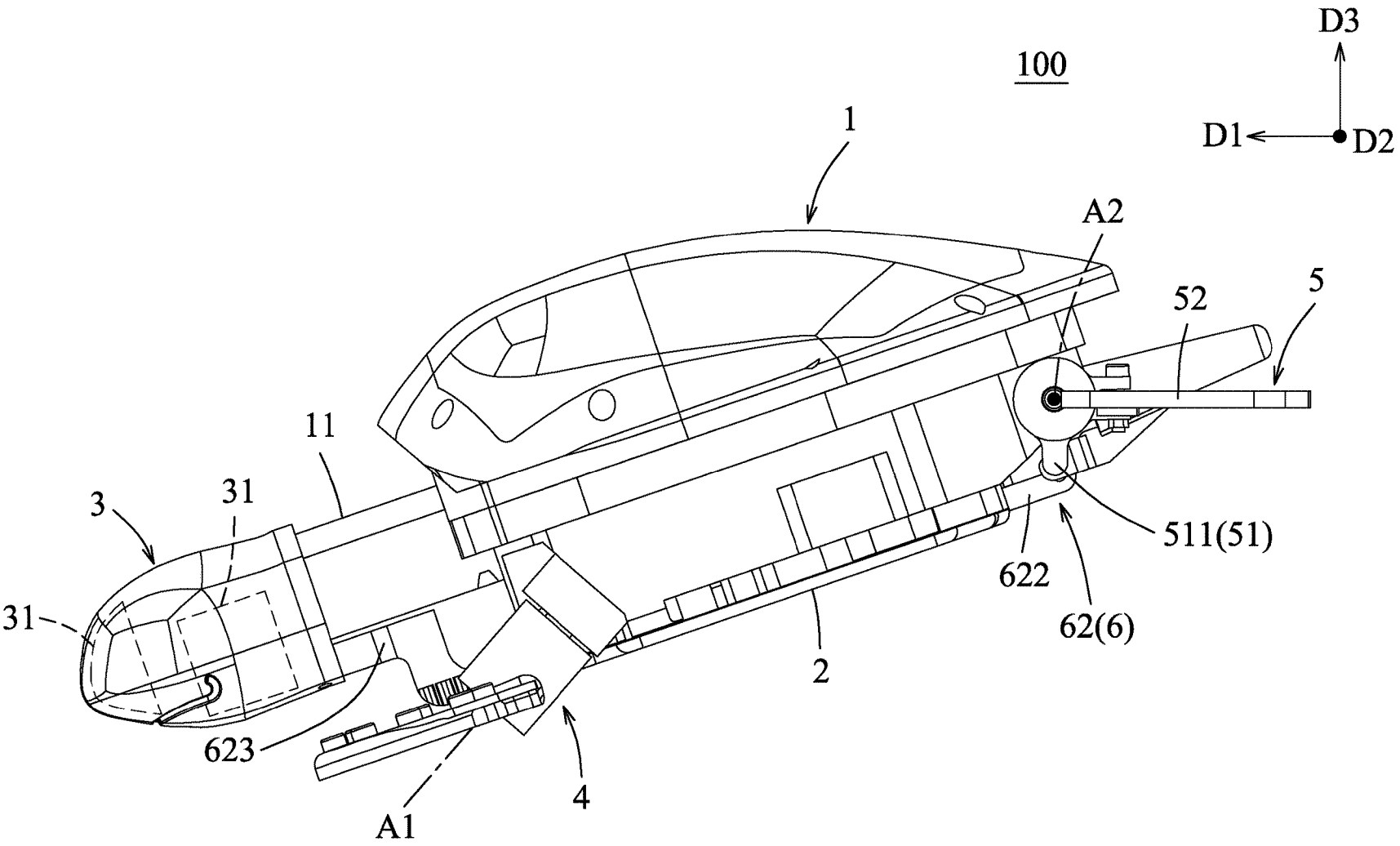
FIG. 10 is a side view similar to FIG. 9, illustrating when the front portion of the embodiment is inclined downwardly.
Figure 11:
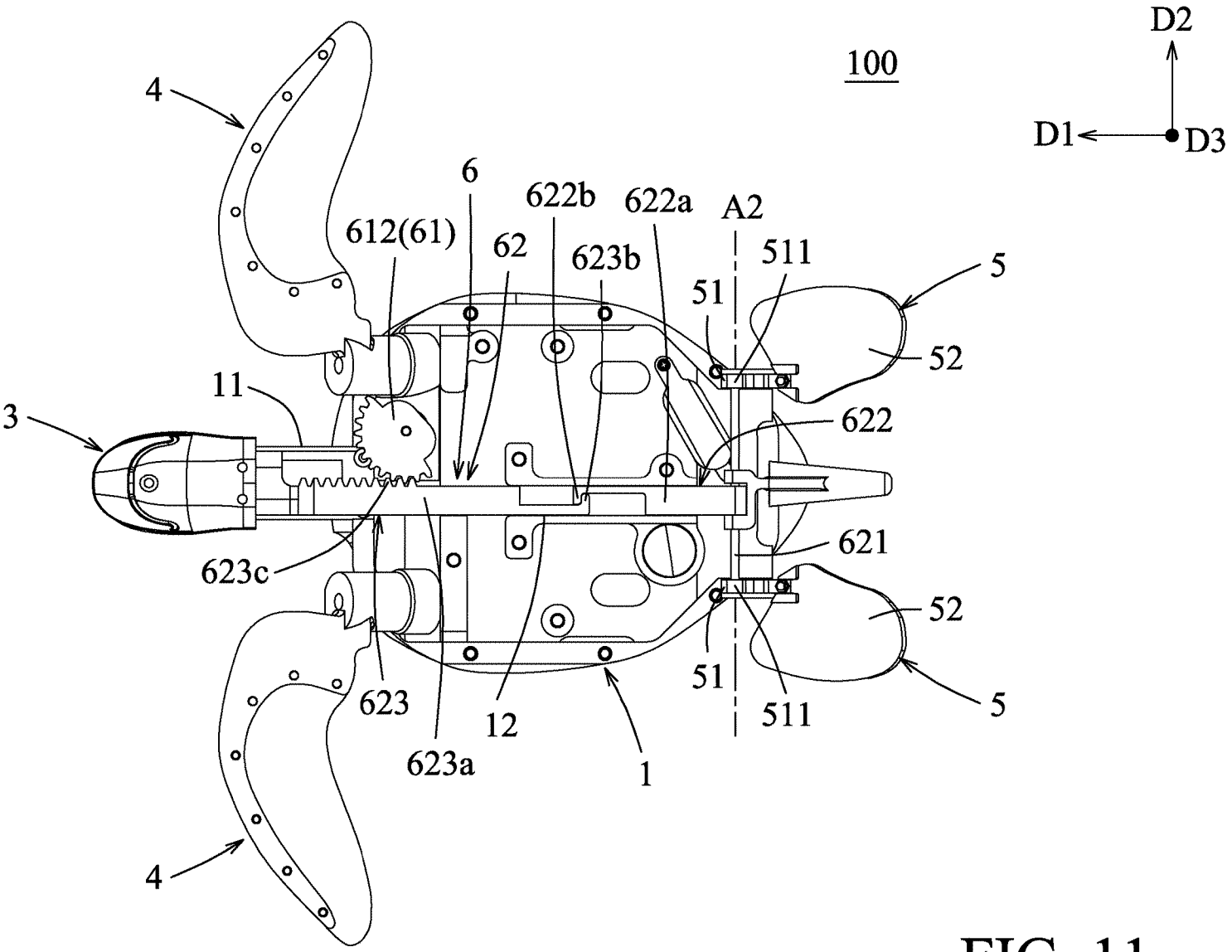
FIG. 11 is a bottom view with the bottom cover being removed, illustrating a state when the head is in the front position.

With reference to FIGS. 9 to 11, when the head 3 is in the front transition position and the front portion of the biomimetic turtle 100 is not inclined downward in the water, the driving module 6 is operated to move the head 3 to the front position. During the forward movement of the head 3 from the front transition position to the front position, the front anchoring portion (623*b*) of the front sliding rod 623 engages and moves the rear anchoring portion (622*b*) of the rear sliding rod 622 forwardly to move the crosspiece 621 and the protrusions 511 of the rear limbs 5 forwardly so as to cause the downward inclination of the rear limbs 5. As shown in FIG. 9, in this state, along with the advancing movement of the biomimetic turtle 100 in the water due to swaying of the front limbs 4 in the up-down direction (D3), a water resistance is generated and applied to the downwardly inclined rear limbs 5 so as to facilitate the downward inclination of the front portion of the biomimetic turtle 100 in the water. Also, through the head 3 being moved more forwardly, the front portion of the biomimetic turtle 100 is encouraged to incline further downwardly in the water for descending, as shown in FIG. 10.

Figure 12:
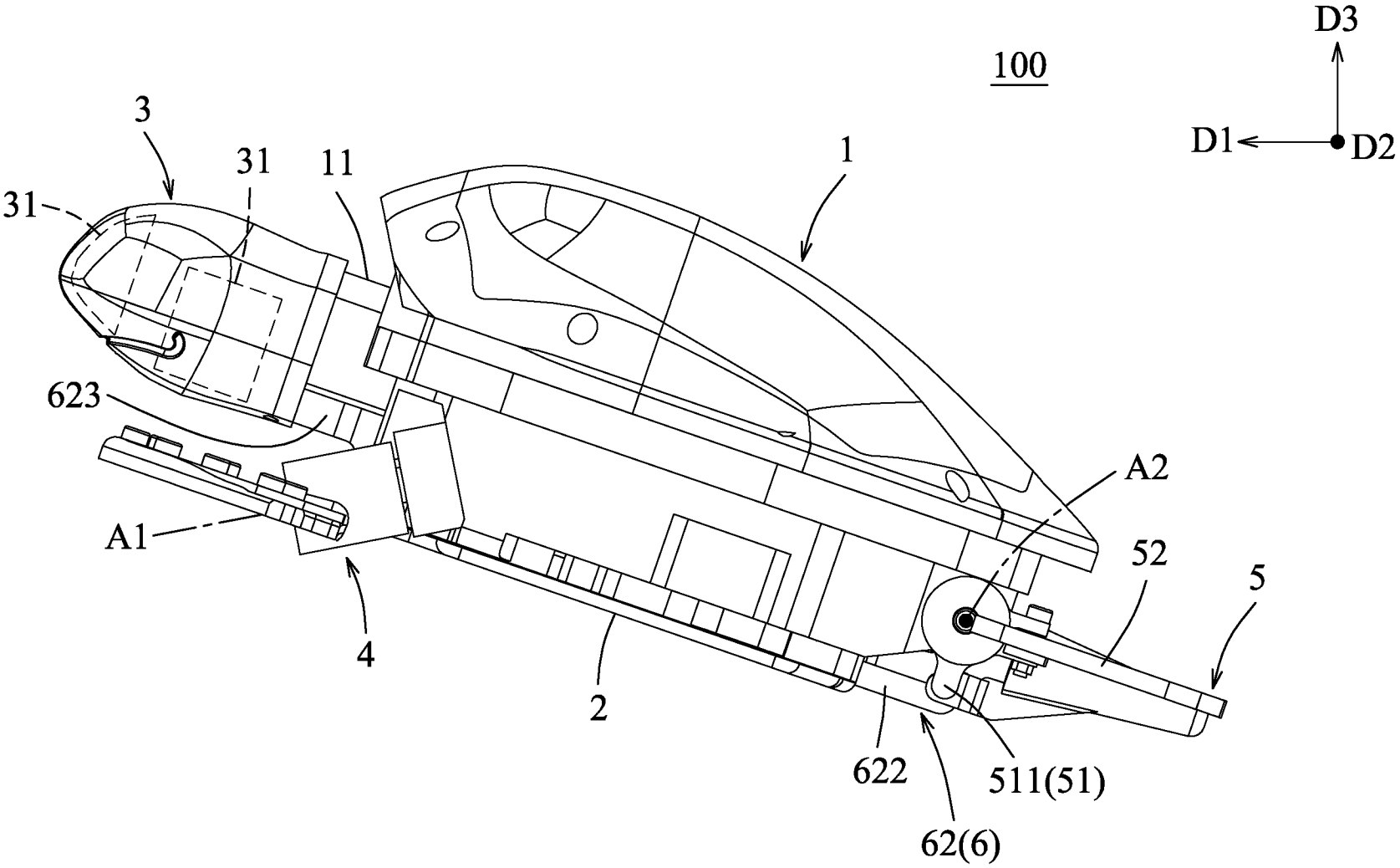
FIG. 12 is a side view illustrating a state when the head is in a rear transition position and a rear portion of the embodiment is inclined downwardly.
Figure 13:
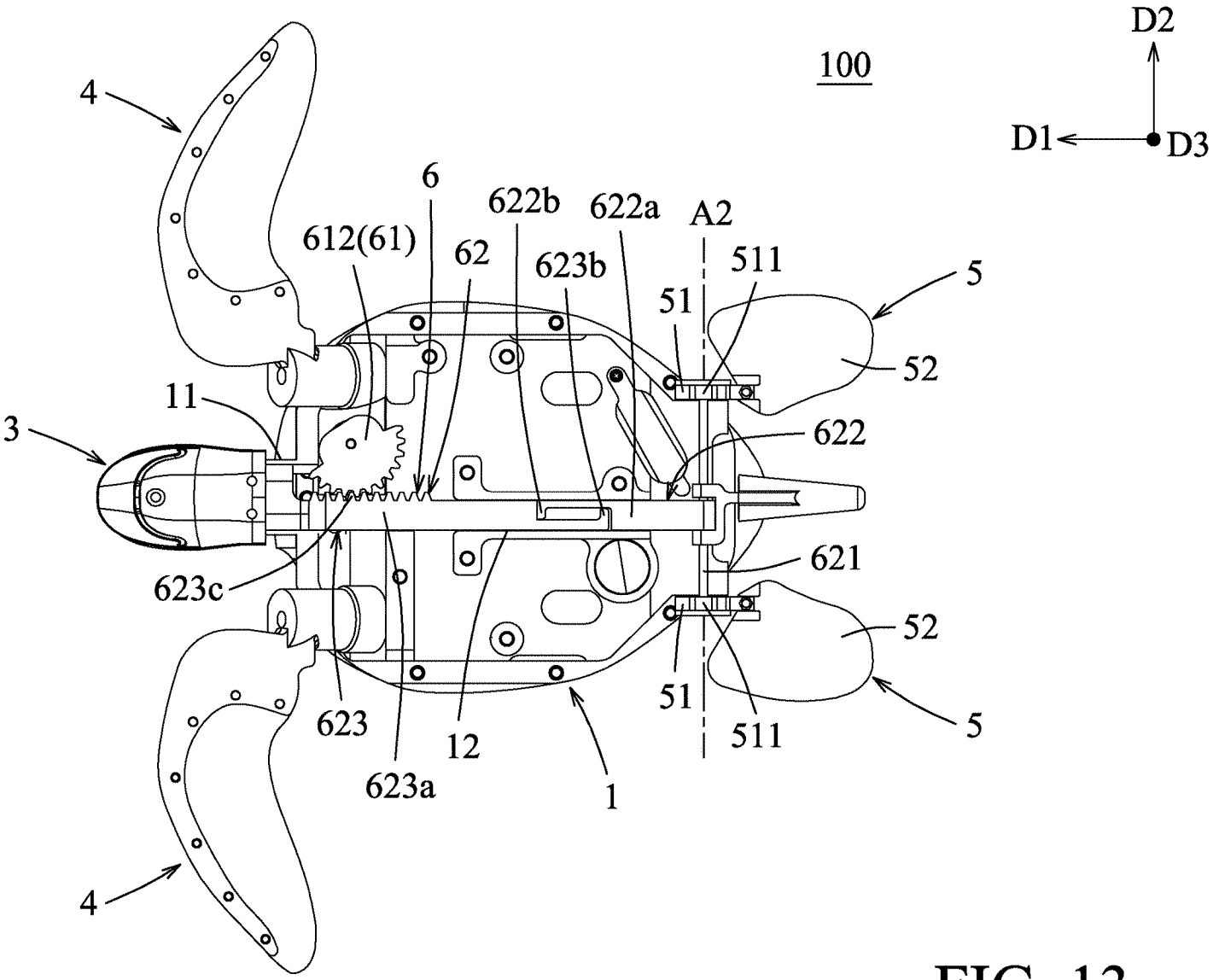
FIG. 13 is a bottom view with the bottom cover being removed, illustrating a state when the head is in the rear transition position.

With reference to FIGS. 12 and 13, when the head 3 is in the rear transition position, a rear end of the front rod portion (623*a*) of the front sliding rod 623 abuts against the rear anchoring portion (622*b*) of the rear sliding rod 622, and the rear ends of the rear limbs 5 extend rearwardly and parallel to the trunk 1. At this stage, through the high-density weight blocks 31 being moved rearwardly with the head 3, the center of gravity of the biomimetic turtle 100 is transferred to a rearward site to facilitate an upward inclination of the front portion of the biomimetic turtle 100 in the water. Also, the swaying of the two front limbs 4 in the up-down direction (D3) further facilitates the biomimetic turtle 100 to ascend.

Figure 14:
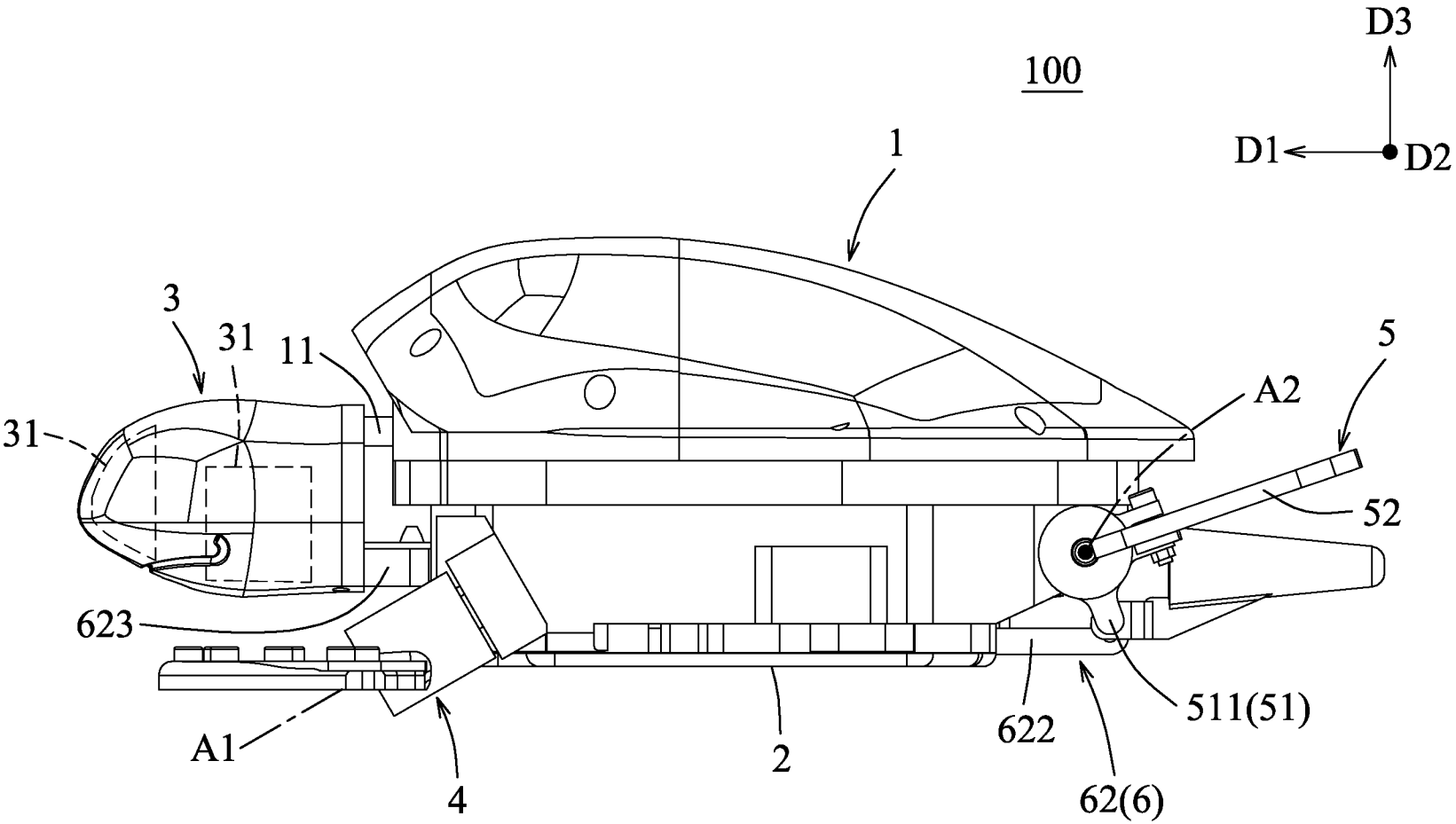
FIG. 14 is a side view illustrating a state when the head is in a rear position and the rear ends of the two rear limbs are inclined upwardly.
Figure 15:
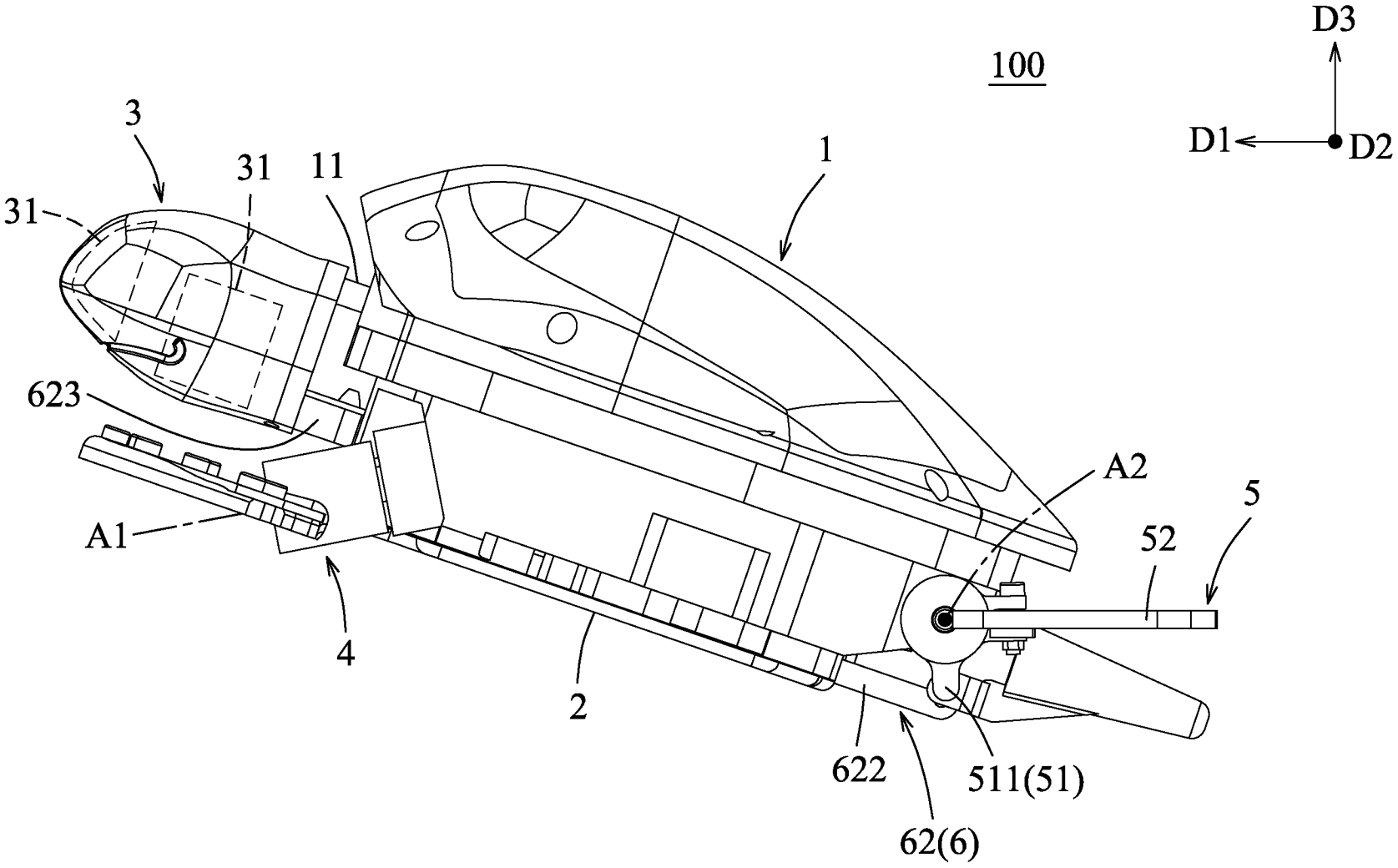
FIG. 15 is a side view similar to FIG. 14, illustrating when the front portion of the embodiment is inclined upwardly.
Figure 16:
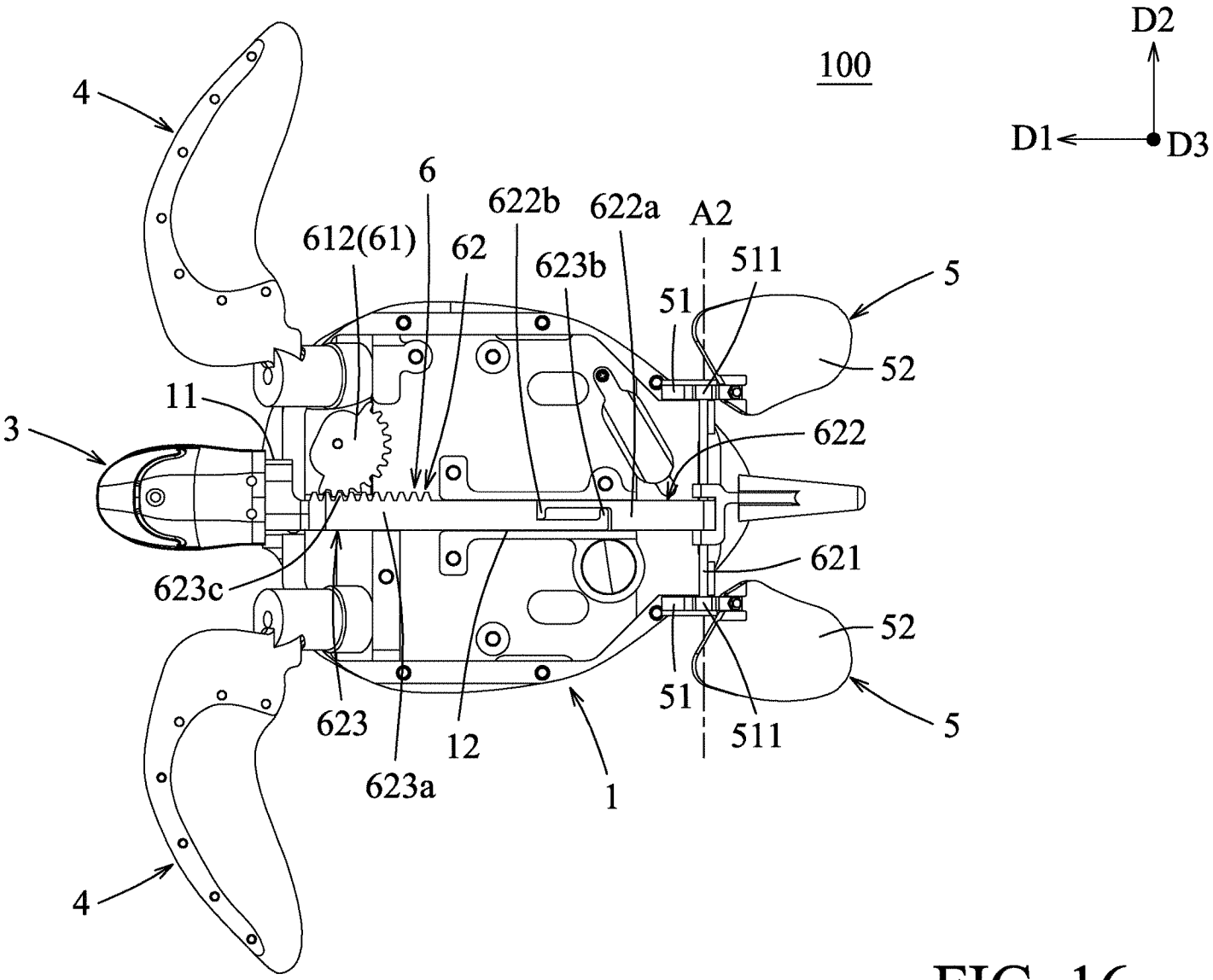
FIG. 16 is a bottom view with the bottom cover being removed, illustrating a state when the head is in the rear position.

With reference to FIGS. 14 to 16, when the head 3 is in the rear transition position and the front portion of the biomimetic turtle 100 is not inclined upward in the water, the driving module 6 is operated to move the head 3 to the rear position. During the rearward movement of the head 3 from the rear transition position to the rear position, the rear end of the front rod portion (623*a*) engages and moves the rear anchoring portion (622*b*) of the rear sliding rod 622 rearwardly to move the crosspiece 621 and the protrusions 511 of the rear limbs 5 rearwardly so as to cause the upward inclination of the rear limbs 5. As shown in FIG. 14, in this state, along with the advancing movement of the biomimetic turtle 100 in the water due to swaying of the front limbs 4 in the up-down direction (D3), a water resistance is generated and applied to the upwardly inclined rear limbs 5 so as to facilitate the upward inclination of the front portion of the biomimetic turtle 100 in the water. Also, through the head 3 being moved more rearwardly, the front portion of the biomimetic turtle 100 further tends to incline upwardly in the water for ascending, as shown in FIG. 15.

As illustrated, with the deformable flipper portion 43 deformed and bent during swaying of the front limbs 4 in the up-down direction (D3), a forward propelling force is generated to propel the biomimetic turtle 100 forwardly. Also, with the head 3 operably movable relative to the trunk 1 in the front-rear direction (D1), the center of gravity of the biomimetic turtle 100 (or the position of generated buoyant force) can be varied in the water, and thus the front portion of the biomimetic turtle 100 is hence inclined upwardly or downwardly to facilitate ascending or descending of the biomimetic turtle 100. The biomimetic turtle 100 has a simple structure and can swim freely in the water.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A biomimetic turtle, comprising:

a trunk;

a head connected with a front end of said trunk in a front-rear direction, and movable relative to said trunk in the front-rear direction;

two front limbs disposed on a front section of said trunk and extending therefrom in a left-right direction away from each other, each of said front limbs being rotatable relative to said trunk about a front rotating axis to sway in an up-down direction, each of said front limbs having a curve-shaped rigid portion which defines a front contour of said front limb and which has a recess that is opened rearwardly, and a deformable flipper portion which is engaged in said recess and which extends rearwardly from said rigid portion; and a driving module mounted on said trunk to drive movement of said head and rotation of said front limbs.

2. The biomimetic turtle of claim 1, wherein said head is provided with at least one high-density weight block to regulate weight of said head.

3. The biomimetic turtle of claim 1, wherein said head is provided with at least one low-density weight block to regulate weight of said head.

4. The biomimetic turtle of claim 1, wherein said trunk has a fixed stem which extends forwardly from said front section thereof, said head being slidably sleeved around said fixed stem to be movable relative to said trunk in the front-rear direction.

5. The biomimetic turtle of claim 1, wherein said head is movable relative to said trunk between a front position which is remote from a rear section of said trunk, and a rear position which is proximal to said rear section of said trunk, said biomimetic turtle further comprising two rear limbs which are pivotably connected with said rear section of said trunk and which extend rearwardly, said driving module including a transmitting mechanism which interconnects said head and each of said rear limbs to transmit a force from said head to move said rear limbs relative to said trunk such that, when said head is in the front position, rear ends of said rear limbs are inclined downwardly relative to said trunk, and that, when said head is in the rear position, said rear ends of said rear limbs are inclined upwardly relative to said trunk.

6. The biomimetic turtle of claim 5, wherein said head is movable relative to said trunk to a front transition position and a rear transition position during movement from the front position to the rear position, wherein, during movement of said head between the front transition position and the rear transition position, said rear ends of said rear limbs extend rearwardly and parallel to said trunk.

7. The biomimetic turtle of claim 6, wherein said rear limbs are rotatable relative to said trunk about a rear rotating axis which is parallel to the left-right direction, each of said rear limbs having an axle section which is journalled on said trunk, and a hind flipper section which extends rearwardly from said axle section, said axle section having a protrusion protruding downwardly therefrom, said trunk having a guide rail extending in the front-rear direction, said transmitting mechanism including a crosspiece which extends in the left-right direction to interconnect said protrusions of said rear limbs, a rear sliding rod which has a rear end connected with said crosspiece and which is slidable along and engaged with said guide rail in the front-rear direction, and a front sliding rod which has a front end connected with said head, which is disposed forwardly of said rear sliding rod and which is slidable along and engaged with said guide rail such that a forward movement of said head from the front transition position to the front position results in downward inclination of said rear limbs, and that a rearward movement of said head from the rear transition position to the rear position results in upward inclination of said rear limbs.

8. The biomimetic turtle of claim 7, wherein said rear sliding rod has a rear rod portion connected with said crosspiece, and a rear anchoring portion extending forwardly from said rear rod portion, said front sliding rod having a front rod portion which is connected with said head at a front end thereof and which abuts against said rear anchoring portion at a rear end thereof when said head is in the rear transition position, and a front anchoring portion which extends rearwardly from said front rod portion and which abuts against said rear anchoring portion when said head is in the front transition position, wherein, during the forward movement of said head from the front transition position to the front position, said front anchoring portion engages and moves said rear anchoring portion forwardly to move said crosspiece forwardly so as to cause the downward inclination of said rear limbs, and wherein, during the rearward movement of said head from the rear transition position to the rear position, said front rod portion engages and moves said rear anchoring portion rearwardly to move said crosspiece rearwardly so as to cause the upward inclination of said rear limbs.

9. The biomimetic turtle of claim 1, wherein said two front limbs are individually driven by said driving module so as to be rotated independently from each other.

* * * * *